US005707421A

United States Patent [19]

Joe

[11] Patent Number: 5,707,421

[45] Date of Patent: Jan. 13, 1998

[54] PROCESS FOR THE INHIBITION OF LEACHING OF LEAD FROM BRASS ALLOY PLUMBING FIXTURES

[76] Inventor: Shelley L. Joe, 2591 Chelsea Ct., Brea, Calif. 92821

[21] Appl. No.: 801,623

[22] Filed: Feb. 18, 1997

[51] Int. Cl.[6] ..... C23G 1/06

[52] U.S. Cl. ..... 75/743; 134/3; 148/282

[58] Field of Search ..... 75/743; 134/3; 148/282

[56] References Cited

U.S. PATENT DOCUMENTS 5,454,876 10/1995 Downey ..... 134/3

*Primary Examiner*—Melvyn Andrews

*Attorney, Agent, or Firm*—Charles C. H. Wu

[57] ABSTRACT

The invention relates to a process for the inhibition and leaching of lead from brass alloy plumbing fixtures including the step of contacting the brass alloy plumbing fixtures with an aqueous nitric acid solution. The aqueous nitric acid solution containing inhibitors selected from the group of block copolymers of propylene oxide and ethylene oxide, fluorocarbon surfactant, polyethylene glycols, and polyols. The aqueous nitric acid solution further contains iron-III chloride.

14 Claims, No Drawings

PROCESS FOR THE INHIBITION OF LEACHING OF LEAD FROM BRASS ALLOY PLUMBING FIXTURES

BACKGROUND OF THE INVENTION

The present invention relates to a process for the inhibition of leaching of lead from brass alloy, specifically for brass plumbing fixtures and inhibits further leaching of lead from brass alloy. The typical brass alloy used in plumbing fixtures contains a small amount of lead, of which can cause a major health concern.

Solutions and methods for removing lead, tin, or lead/tin coating from the surface of a printed wiring board are known in the prior art. For example, in U.S. Pat. No. 4,919,752 to Mika. Specifically disclosed in the Mika patent is a process of removing lead and tin coatings formed at the intermetallic intermediate layer at the interface between the nickel or copper electrical circuit layers. Circuit board manufacturing typically requires the formation of the lead and tin coatings between layers of circuits.

The process of prior art does not disclose the application of leaching of lead and inhibition of further lead leaching from brass alloy used in typical plumbing fixtures.

Thus, there is a need for a process that leaches lead and inhibits further leaching of lead from the everyday plumbing fixtures.

SUMMARY OF INVENTION

The present invention meets this need by providing an aqueous acidic solution with ionic materials together with inhibitor for the removal of lead from the brass alloy plumbing fixtures.

The objective of the present invention is accomplished by use of an aqueous solution containing nitric acid and a inhibitor of block copolymer of ethylene oxide of propylene oxide, polyethylene glycol, and polyols with a molecular weight of 2000 or more.

As the result adding the block of copolymer inhibitor to the aqueous solution, a negligible attack on the brass material occurs due to the inhibitor's effect while lead is being leached from the brass material.

The present invention discloses the use of a nitric acid solution as the leaching medium. The nitric acid contains an inhibitor of block copolymer of ethylene oxide of propylene oxide, polyethylene glycol, and polyols with a molecular weight from 800 to 8000.

Block copolymers comprised of propylene oxide and ethylene oxide of molecular weight 1000 and 10% ethylene oxide to F127 R, of which comprises of molecular weight 12,700 and 70% ethylene oxide of BASF Wyandotte chemicals, have been found to be particularly suitable for this application.

It has been found that where the leaching solution containing iron-III chloride and one of the above-mentioned inhibitors, the base metal would not be corroded by the process. The preferred leaching solution contains from 5 to 8 g/L of iron-III chloride.

In summary, in accordance to the present invention, the preferred leaching solution contains nitric acid from 20% to 30% by weight, 0.02 to 0.10 g/L of Inhibitor, Iron III chloride from 5.0–8.0 g/L, and deionized water.

The preferred composition of the leaching solution of the present invention is as follows:

aqueous solution of $HNO_3$, 25% by weight;

iron-III Chloride: 6.5 g/L;

F127: 0.03 g/L (polyethylene glycol); and deionized water bathing temperature 20°–25° C.

Preferably, the brass fixture remains in the leaching solution between 1.5 to 2.0 minutes for cauterizing.

An exemplary process of leaching lead from brass plumbing fixtures of the present invention is as follows:

a. Provide a facility with adequate ventilation;

b. immersing said brass plumbing fixtures into an aqueous solution having the following composition:
   $HNO_3$, 25% by weight;
   iron-III Chloride: 6.5 g/L;
   F127: 0.03 g/L (polyethylene glycol); and
   deionized water; and c. The brass surface remains intact. No corrosion on the base material is found.

Although the present invention has been described in considerable detail, other versions are possible. For example, the leaching solution can be sprayed onto the brass plumbing surface. Also, the inhibitors can be selected from a group of block copolymers of propylene oxide and ethylene oxide, fluorocarbon surfactants, polyethylene glycols, and polyols with a molecular weight of more than 2000.

What is claimed is:

1. Process for the removal and inhibition of leaching of lead contained within the brass material of plumbing fixtures, by immersing the brass plumbing fixtures in an aqueous leaching solution for sufficient time to remove lead, the aqueous leaching solution contains nitric acid and one or several inhibitors selected from the group of block copolymers of polyethylene glycols, propylene oxide and ethylene oxide, fluorocarbon surfactants, and polyols.

2. The process of claim 1, where said nitric acid is between 20 to 35% by weight.

3. The process of claim 1, wherein said group of block copolymers of polyethylene glycols, propylene oxide and ethylene oxide, fluorocarbon surfactants, and polyols having a molecular weight between 100 to 8000.

4. The process of claim 1, wherein said leaching solution further comprised of iron-III chloride.

5. The process of claim 4, wherein said iron-III chloride having concentration of 5 to 8 grams per liter.

6. The process of claim 1, wherein said leaching solution is used at a temperature not exceeding 25 degrees Celsius.

7. The process of claim 1, wherein the cauterizing time used not exceeding 2 minutes.

8. The process for the removal and inhibition of lead contained within the brass surface of plumbing fixtures, by contacting the brass surface of the plumbing fixtures with an aqueous leaching solution, said aqueous leaching solution being characterized in that the leaching solution contains nitric acid and one or several inhibitors selected from the group of block copolymers or propylene oxide and ethylene oxide, fluorocarbon surfactants, polyethylene glycols, and polyols with a molecular weight of more than 2000.

9. The process of claim 8, wherein the aqueous leaching solution contains from 20 to 35% by weight nitric acid.

10. The process of claim 8, wherein the aqueous leaching solution contains from 0.02 to 0.10 gram per liter of inhibitor.

11. The process of claim 8, wherein the aqueous leaching solution contains from 5 to 8 grams per liter of iron-III chloride.

12. The process of claim 8, wherein the aqueous leaching solution contains from 20 to 35% by weight nitric acid, and from 0.02 to 0.10 grams per liter of inhibitor.

13. The process of claim 8, wherein the aqueous leaching solution contains from 20 to 35% by weight nitric acid, from 0.02 to 0.10 grams per liter inhibitor, and from 5 to 8 grams per liter of iron-III chloride.

14. Process for the removal and inhibition of lead leaching contained within the brass material of plumbing fixtures with an aqueous leaching solution for a sufficient time to remove lead contained therein, the aqueous leaching solution comprised of nitric acid having 20 to 35% by weight, one of several inhibitors selected from the group of block copolymers of polyethylene glycols, propylene oxide and ethylene oxide, fluorocarbon surfactant, and polyols having molecular weight between 100 and 8000, and iron-III chloride having concentration from 5 to 8 grams, the ambient temperature not exceeding 25 degrees Celsius, and the cauterizing time used not exceeding 2 minutes.

* * * * *